United States Patent [19]

Smith

[11] Patent Number: 4,574,509

[45] Date of Patent: Mar. 11, 1986

[54] AMBIDEXTROUS CARTRIDGE MAGAZINE RETAINING CATCH FOR SELF LOADING FIRE ARMS

[76] Inventor: David E. Smith, 5 Park Ave., Telscombe Cliffs, Sussex, England

[21] Appl. No.: 593,408

[22] Filed: Mar. 26, 1984

[30] Foreign Application Priority Data

Mar. 28, 1983 [GB] United Kingdom ..... 8308420

[51] Int. Cl.[4] ..... F41C 25/06

[52] U.S. Cl. ..... 42/7

[58] Field of Search ..... 42/7, 6, 18

[56] References Cited

U.S. PATENT DOCUMENTS 3,715,826 2/1973 Seifried ..... 42/7

4,326,353 4/1982 Ludwig et al. ..... 42/7

FOREIGN PATENT DOCUMENTS 3300614 8/1983 Fed. Rep. of Germany ..... 42/7

*Primary Examiner*—Charles T. Jordan

*Attorney, Agent, or Firm*—Harness, Dickey & Pierce

[57] ABSTRACT

A self loading fire arm having manually releasable means for holding a box magazine in a well in the fire arm frame which is operable by either hand on either side of the fire arm. The releasable means comprises an aperture (T1) in the front wall of the magazine which is engaged by the nose (VV1) of a catch (VV) pivotable in a slot in the wall of the well from a central position in which the catch nose engages the aperture (T1) to either of two extreme positions in which the nose is withdrawn from the aperture, pivoting of the catch being effected from either side by means of a double plunger (UU).

4 Claims, 14 Drawing Figures

A1
A2
A3
A4
A5
A
B
C
D
T
T1
V
VV
VV1
VV3
WW
XX
UU

WW1
WW2

AMBIDEXTROUS CARTRIDGE MAGAZINE RETAINING CATCH FOR SELF LOADING FIRE ARMS

This invention relates to self loading fire arms in which a box magazine is employed, and more particularly to such fire arms having means for holding the magazine in a positive position to allow cartridges in the magazine to be correctly fed from the magazine to the pistol barrel breech chamber, and for manually releasing the said magazine from its position in the fire arm frame.

The usual practice in self loading pistols is for them to employ a catch which is forced by spring pressure to intrude into a passage or well enclosed by the pistol grip frame, thereby holding the cartridge magazine in a positive position, to allow the breech block slide to remove a cartridge from the magazine lips on the return of the slide after recoil.

One known form of magazine retaining catch used in self loading pistols operates transversely in the frame, being depressed in one direction to release the magazine from the frame well. Another type of magazine catch is placed at the rear of the grip frame base, and is moved by the free hand of the user to release the magazine.

The disadvantage of the transverse single direction catch is that it is not convenient for use with either hand.

The disadvantage of a catch engaging with the base of the magazine and mounted on the grip base, is that the catch cannot be operated by the firing hand.

Greater convenience would be provided by a magazine retaining and release catch that could be ambidextrously operated, whether the pistol be held in the right or left hand.

It is an object of the invention, therefore, to provide for self loading pistols and other fire arms, a magazine retaining and release catch mounted in a convenient position for operation from either side of the pistol or other fire arm, either by the firing hand or by the free hand.

It is another object of the invention to simplify the manipulations involved in disassembling and assembling a self loading pistol or fire arm.

It is another object of the invention to provide for self loading pistols or other fire arms a cartridge magazine retaining and release catch which can be disassembled and assembled in said pistol or other fire arm without the use of specific tools.

It is a further object to provide a magazine catch for a self loading pistol or fire arm that is of simple construction and cheap to manufacture.

According to the invention, therefore, a self loading fire arm comprises manually releasable means for holding a box magazine within an enclosed well in the frame of the firm arm in a position to allow cartridges to be sequentially fed from the magazine into the barrel breech chamber of the fire arm, said means comprising an aperture in the front wall of the magazine, a catch, pivotally movable against a spring loading within a slot-shaped opening in the wall of said well adjacent the front wall of the magazine, from a central position in which the catch engages in said aperture to hold the magazine in the well, to either of two extreme positions in which the catch is withdrawn from said aperture, thereby freeing said magazine, and means manually operable from either side of the fire arm to move said catch against said spring loading from the central position to a respective one of said extreme positions.

An embodiment of the invention is shown in the drawings and will be described in greater detail hereinafter.

The same letters of reference indicate corresponding parts in the several figures of the drawings.

FIG. 1 of the accompanying drawings represents, partly in elevation and partly in longitudinal vertical section, a self loading semi automatic pistol provided with means constructed and arranged in accordance with this invention for the retention of the cartridge magazine and means to permit removal of same magazine, showing the pistol with a partially loaded magazine inserted in the grip frame, held in position by the magazine catch;

Figures 1, 2, 3, 4:
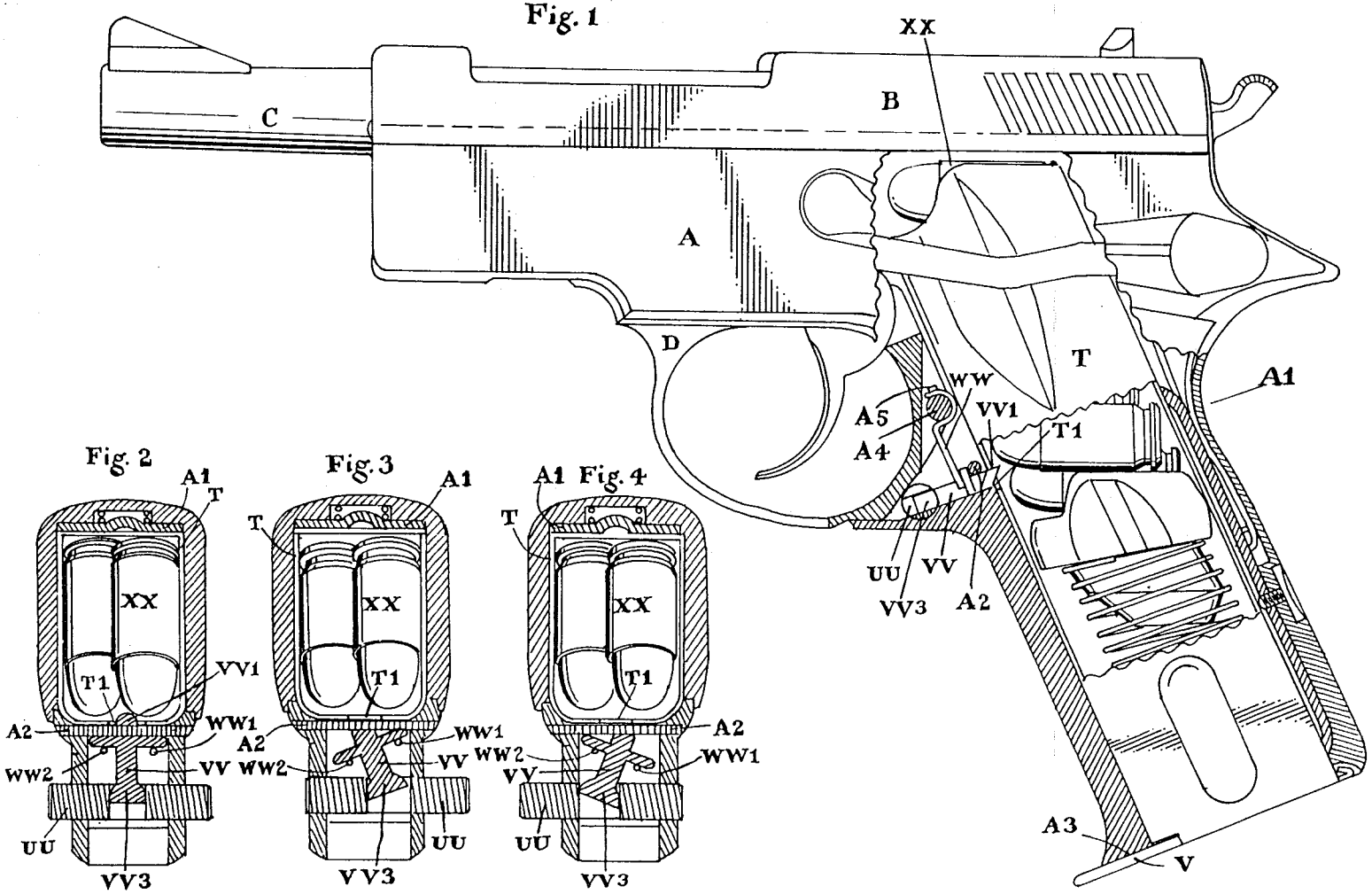
FIG. 2 is a transverse horizontal section along the line 1 of FIG. 1.
FIG. 3 is a transverse horizontal section along the line 1 of FIG. 1, with the magazine catch plunger depressed from the right side of the pistol.
FIG. 4 is a transverse horizontal section along the line 1 of FIG. 1 with the magazine catch plunger depressed from the left side of the pistol.
Figure 5:
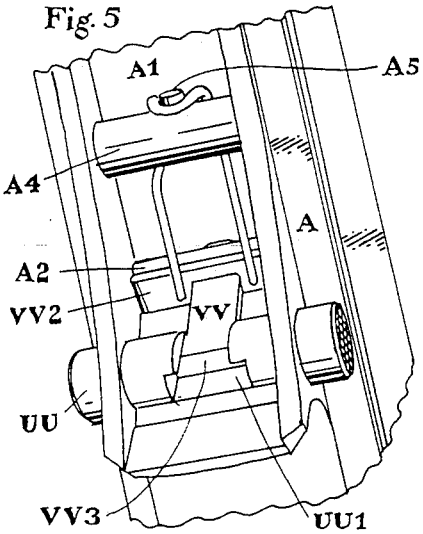
FIG. 5 is a perspective view of the magazine catch recess, viewed from the front of the pistol, with the trigger guard removed, and magazine removed.
Figure 6:
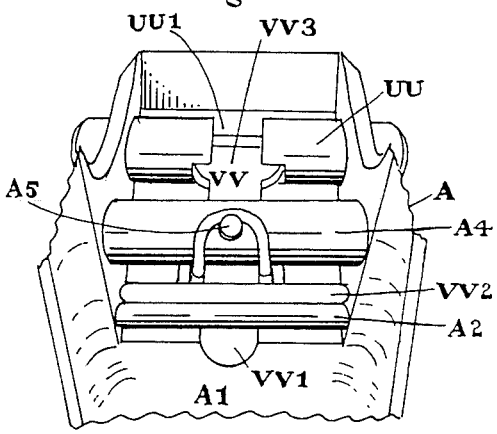
FIG. 6 is a perspective view of the magazine catch recess, viewed from above, slightly to the rear, with trigger guard removed, and magazine removed.
Figure 7:
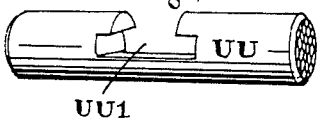
FIG. 7 is a perspective view of the magazine catch plunger.
Figure 11:
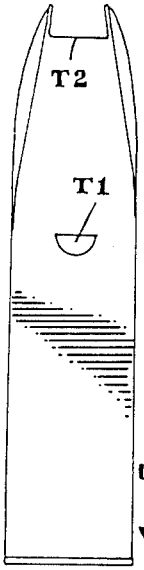
FIG. 11 is a front view of the magazine.
Figure 12:
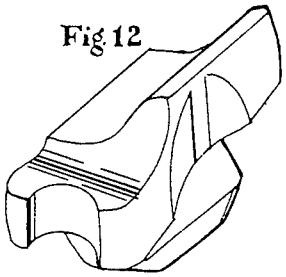
FIG. 12 is a perspective view of the magazine follower viewed from the front.
Figure 13:
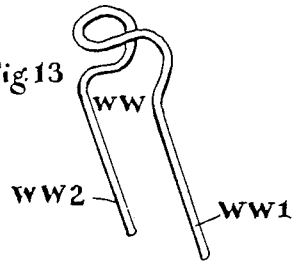
FIG. 13 is a perspective view of the magazine catch spring.
Figure 14:
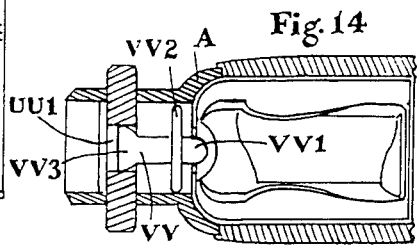
FIG. 14 is a longitudinal transverse section view along line 1 with magazine follower on same plane as magazine catch.

In the self loading pistol represented in FIG. 1 the magazine T is accommodated in magazine well A1 in the grip section of the frame A and is held securely in position, from which the uppermost cartridge XX can be accurately fed by the Slide B into the chamber of the Barrel C, by the magazine catch nose VV1, which is forced by the magazine catch spring WW acting upon the magazine catch bridge VV2, to enter the aperture T1 which is cut out of the front centre of the magazine body, as shown in FIG. 11.

Upon the insertion of the magazine into the grip well the magazine nose T2 will bear against the angled surface of the magazine catch nose and cam the magazine catch VV forwards. The magazine catch tail is free to move in a longitudinal manner in the T slot UU1 of the magazine catch plunger. The magazine catch nose is prevented from moving upwards by the frame pin A2 which is fitted transversely in the frame as shown in the drawings. The magazine base plate V will seat against the foot A3 of the frame grip and the magazine will be in the proper position for the magazine catch nose to enter the magazine aperture.

The magazine is removed by applying equal pressure on either end of the magazine catch plunger UU, as shown in FIG. 3 and FIG. 4. It will be seen in FIGS. 3 and 4 that when the magazine catch bridge pivots on either extremity the magazine catch nose will be withdrawn from the magazine well. FIG. 2 shows the magazine with cartridges, held in the magazine well by the magazine catch protruding into the magazine aperture. The magazine spring tails WW1 and WW2 force the magazine catch bridge against frame pin A2 and thereby holds the magazine catch tail VV3 in a central position in the magazine catch recess. It will be seen in FIG. 3 and FIG. 4 that when lateral pressure is exerted on the magazine catch plunger, the magazine catch tail which is retained in the magazine catch plunger T slot is forced to the left or right, relative to the direction of traverse of the magazine catch plunger. The magazine catch will pivot on either extremity of the magazine catch bridge bearing against frame pin A2 depending on which direction the magazine catch tail is moved. The magazine catch spring tails are free to move independently and will accommodate any directional movement of the magazine catch bridge and will force the bridge to return flush with the frame pin A2. The magazine catch bridge cannot move in a lateral direction due to the confines of the magazine catch well sides. The magazine catch spring is retained on the frame pin A4 which is transversely fixed in the frame as shown in the drawings, the frame pin A4 having a stud A5 which prevents the magazine catch spring from rotating when forward pressure is exerted in either or both magazine catch spring tails.

Figure 8:
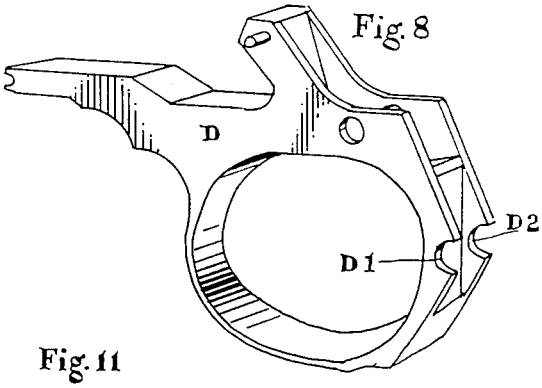
FIG. 8 is a perspective view of the trigger guard
Figure 9:
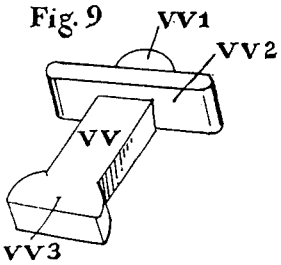
FIG. 9 is a perspective view of the magazine catch
Figure 10:
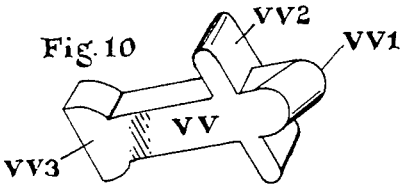
FIG. 10 is another perspective view of the magazine catch.

In the pistol shown the trigger guard D is a separate unit, the recesses D1 and D2 as shown in FIG. 8 seating on frame pin A4.

To remove the whole magazine catch unit the magazine catch is moved until the nose is forward of the frame pin A2 and the catch nose is then lifted upwards, the magazine catch tail being in the T slot of the magazine catch plunger will rotate the plunger and when the catch nose is clear of frame pin A2 the catch can be withdrawn rearwards into the magazine well, between frame pin A2 and pin A4. The magazine catch plunger will then be free to be removed transversely from either side of the pistol.

While the invention has been particularly described with reference to a pistol, it is applicable to all other types of repeating fire arms, such as rifles and machine guns. The application of the invention to other fire arms differs in no essential respect from its application to the pistol hereinbefore described.

The terms "horizontal" and "vertical" as used herein refer to the pistol or other fire arm when held in the normal firing position.

I claim:

1. A self-loading fire arm comprising manually releasable means for holding a box magazine within an enclosed well in the frame of the fire arm in a position to allow cartridges to be sequentially fed from the magazine into the barrel breech chamber of the fire arm, said means comprising an aperture in the front wall of the magazine;

a catch pivotally movable within a slot-shaped opening in the wall of said well adjacent the front wall of the magazine from a central position in which the catch engages in said aperture to hold the magazine in the well to either of two extreme positions in which the catch is withdrawn from said aperture, thereby freeing said magazine;

separately movable spring elements urging said catch towards said aperture; and a double-ended plunger mounted for axial movement transversely in the fire arm frame, and movable from either side of the fire arm to move said catch from the central position to a respective one of said extreme positions against spring loading provided by a respective one of said spring elements, and thereby to withdraw said catch from said aperture, said catch comprising a nose portion adapted to engage in said aperture, a tail portion adapted to engage in an aperture in said plunger and to be moveable therewith, and a transverse bridge portion on the side of which remote from the well said spring elements are located to urge said nose portion towards said aperture, whereby movement of said plunger to either extreme position thereof causes pivotal movement of said catch to free said nose portion from said aperture against the pressure exerted by a respective one of said spring elements.

2. A fire arm as claimed in claim 1, wherein said spring elements are formed by respective tails of a spring passing round a pin transversely mounted in said frame and prevented from rotation when pressure is exerted on either tail thereof in the forward direction of the fire arm by a stud on said pin.

3. A fire arm as claimed in claim 1, wherein said catch, when in said central position, is retractable against said spring loading by pressure on the underside of said nose portion, whereby a magazine can be loaded into said well with the catch in said central position.

4. A fire arm as claimed in claim 3, wherein the upper side of said slot-shaped opening is formed by a further pin transversely mounted in said frame in an opening in the wall of said well, said catch being further retractable against said spring loading so that the nose portion clears said further pin, when the catch can be withdrawn rearwardly through the opening in the wall of the well above said further pin into the well and said plunger can be withdrawn from either side of the frame.

* * * * *